US007994986B2

(12) United States Patent
Desclos et al.

(10) Patent No.: US 7,994,986 B2
(45) Date of Patent: Aug. 9, 2011

(54) ANTENNA WITH NEAR FIELD DEFLECTOR

(75) Inventors: Laurent Desclos, San Diego, CA (US); Sebastian Rowson, San Diego, CA (US)

(73) Assignee: Ethertronics, Inc., San Diego, CA (US)

( * ) Notice: Subject to any disclaimer, the term of this patent is extended or adjusted under 35 U.S.C. 154(b) by 544 days.

(21) Appl. No.: 11/840,617

(22) Filed: Aug. 17, 2007

(65) Prior Publication Data

US 2009/0046022 A1 Feb. 19, 2009

(51) Int. Cl.
*H01Q 1/24* (2006.01)
*H01Q 1/52* (2006.01)

(52) U.S. Cl. ..... 343/702; 343/841

(58) Field of Classification Search ..... 343/702, 343/833, 834, 841, 846; 455/575.7
See application file for complete search history.

(56) References Cited

U.S. PATENT DOCUMENTS 4,410,890 A * 10/1983 Davis et al. ..... 342/419
4,528,566 A * 7/1985 Tyler ..... 342/419
7,158,820 B2 * 1/2007 Suzuki et al. ..... 455/575.7

* cited by examiner

*Primary Examiner* — Michael C Wimer
(74) *Attorney, Agent, or Firm* — Coastal Patent Agency

(57) ABSTRACT

A mobile communication device having primary resonator coupled to a near field deflector. The near field deflector forms a false edge for near field deflection wherein the primary resonator couples with the false edge instead of to metallic portions of the device or the user.

2 Claims, 19 Drawing Sheets

102

Figure 8a
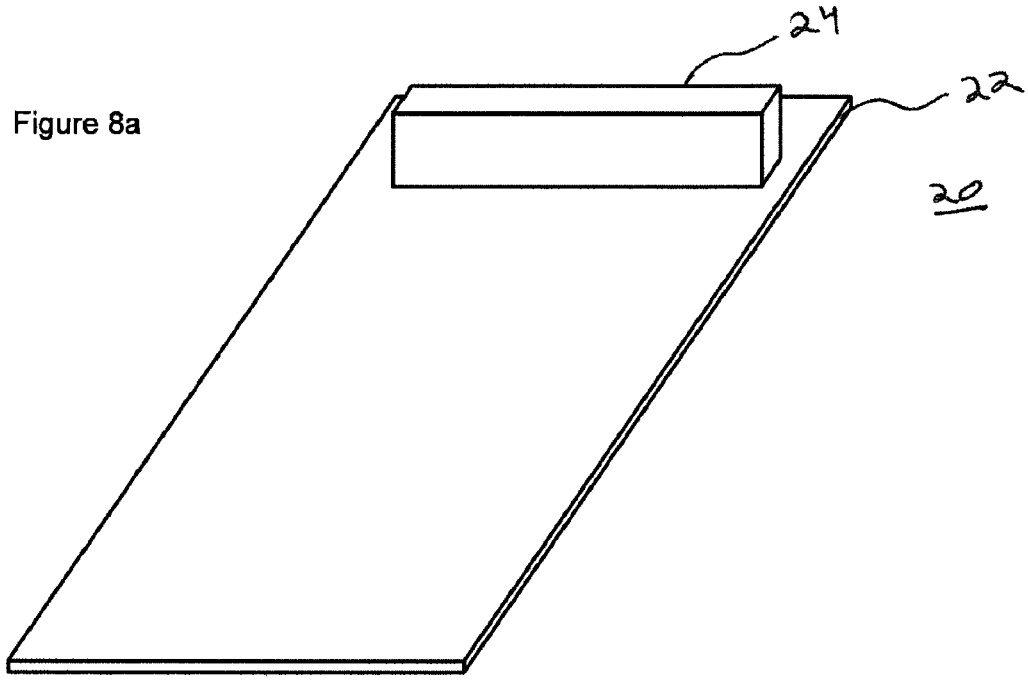
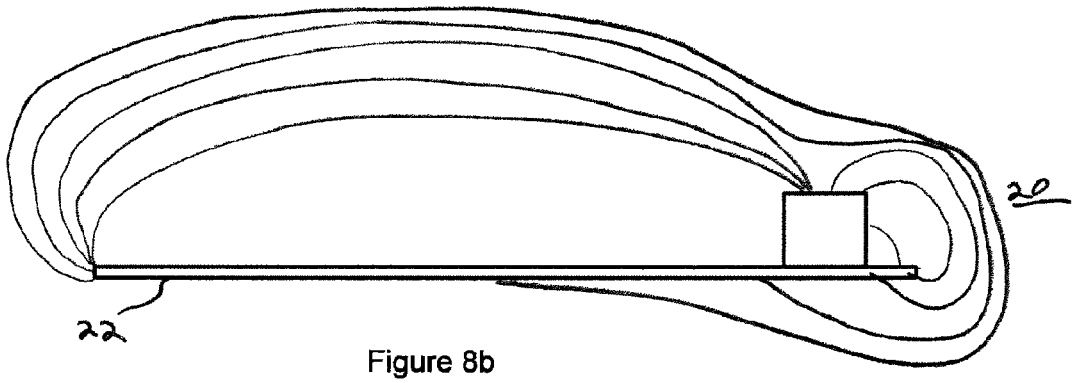
Figure 8b
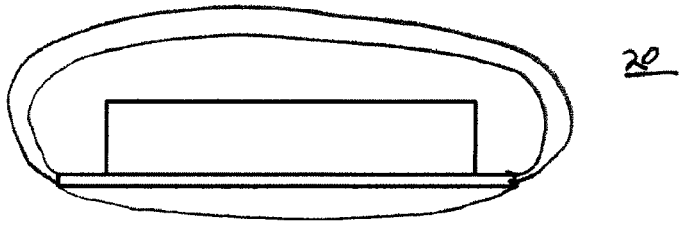
Figure 8c

Figure 9a
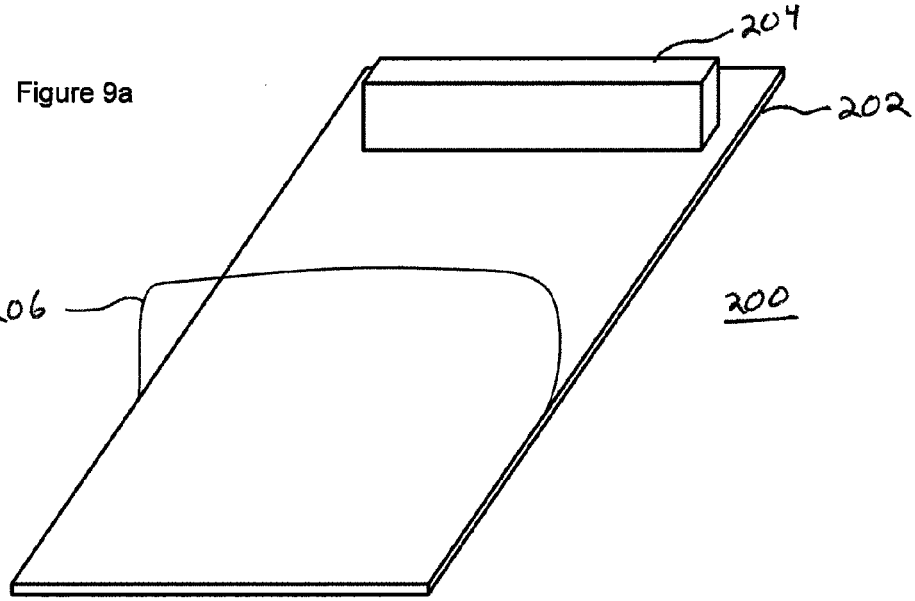
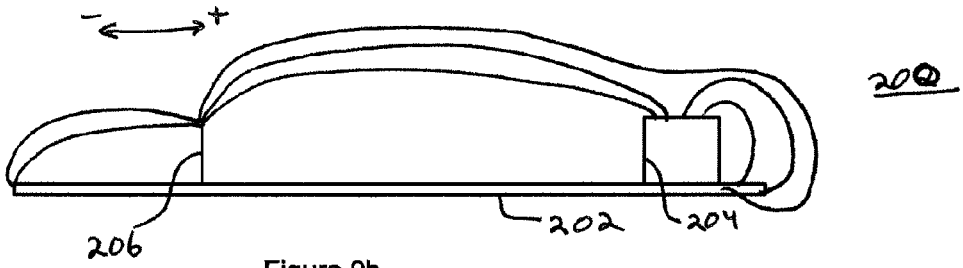
Figure 9b
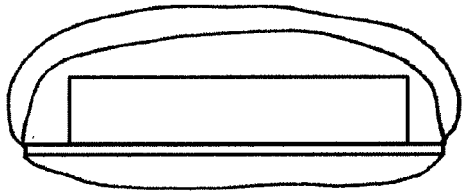
Figure 9c
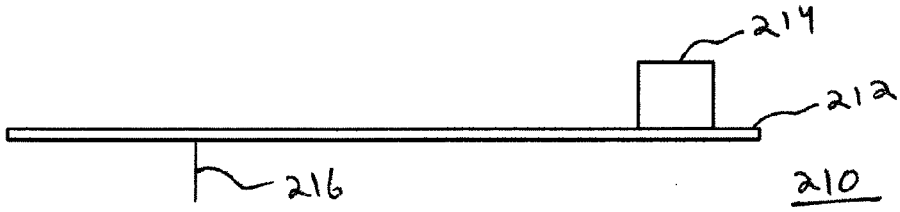
Figure 10

ANTENNA WITH NEAR FIELD DEFLECTOR

FIELD OF THE INVENTION

The present invention relates generally to low frequency antenna designs for communication devices and more particularly to multi-band low frequency antenna designs configured to prevent unwanted near field coupling with items, internal or external to the communication device.

BACKGROUND

The design of low frequency dual band internal antennas for use in modern cell phones poses many challenges. Standard technologies require that antennas be made larger when operated at low frequencies. With present cell phone designs leading to smaller and smaller form factors, it becomes more difficult to design internal antennas for low frequency applications.

The form factor of mobile phones also creates a coupling problem due to the arrangement of the antenna in proximity to metallic objects. As phones have become more compact, near field interactions have become an increasing problem. One common situation involves decreased performance of the phone due to coupling of the antenna with the speaker. In addition to coupling with the speakers and other internal components of the mobile, the antenna of standard mobile phones may couple with external metal objects such as eye glasses or earrings. The present invention addresses deficiencies of prior art antenna designs.

SUMMARY OF INVENTION

One or more parasitic resonator elements, as further described herein, are used to create secondary resonances in a primary antenna. Because only one relatively large primary antenna is required, more antenna "real estate" is available for phone design, whether it is a reduction of phone size, larger phone display, etc.

In one embodiment, a multi-frequency communications device comprises a primary antenna, the primary antenna for enabling a frequency at which the communications device operates; and a resonator element, wherein an excited resonator element couples with the primary antenna to alter the frequency at which the communications device operates. The primary antenna may comprise a low frequency antenna. The low frequency may be within the 300 to 500 MHz frequency band. The primary antenna may comprise a coil antenna. The radiation pattern of the primary antenna may comprise a dipole-type radiation pattern. The radiation pattern of the resonator element may comprise a quadrapole-type radiation pattern. The resonator element may comprise a spiral geometry. The resonator element may comprise a dipole geometry. The communications device may comprise a housing, wherein the resonator element is disposed within the housing of the communications device. The communications device may operate at two or more low frequencies. The communications device may comprise a stub antenna, wherein only the primary antenna comprises a stub antenna. The communications device may comprise a phone. The communications device may comprise a PDA type device.

In one embodiment, a phone for operating at a frequency may comprise a plurality of resonator elements, wherein one excited resonator element couples with another resonator element to effectuate the operating frequency at which the phone operates. One of the plurality of resonator elements may radiate with a dipole radiation pattern. At least one other of the plurality of resonator elements may radiate with a quadrapole radiation pattern. At least one of the plurality of resonator elements may comprise a parasitic resonator. The phone may comprise a multi-band low frequency phone, wherein the phone comprises a housing, and wherein at least one of the plurality of resonator elements is coupled to the housing. The multi-band low frequency phone may comprise only one stub antenna. The frequency may be in a range below or above 1 GHz.

In one embodiment, a resonator for use with a primary antenna in a phone comprises a parasitic element, wherein when excited the parasitic element couples with the primary antenna to change an operating characteristic of the primary antenna. The parasitic element when excited exhibits a quadrpole-type of radiation pattern. The primary antenna may comprise a stud type antenna.

In one embodiment, a resonator for use with a primary antenna in a phone may comprise parasitic coupling means for parasitically coupling to the primary antenna so as to change an operating characteristic of the primary antenna.

In one embodiment, a method of using a parasitic resonator in a communications device may comprise the steps of: providing a primary antenna that exhibits a radiation pattern when excited; providing a parasitic resonator that comprises a radiation pattern when excited; positioning the parasitic element such that when excited it electronically couples to the primary antenna so as to change an operating characteristic of the primary antenna. The communications device may comprise a phone. The communications device may comprise a PDA. The primary antenna may comprise a stub type antenna. The communication device utilizes only one stub type antenna. The operating characteristic may comprise an operating frequency that is less than 1 GHz.

In one exemplary embodiment, the primary and secondary resonator are used in a mobile communications device. In one embodiment, the secondary resonator is positioned to provide a near field deflector. The position of the secondary resonator is such to prevent coupling of the primary resonator with another component, either internal or external to the communications device.

Other embodiments are within the scope of the claimed invention and will become apparent from the descriptions provided herein.

BRIEF DESCRIPTION OF THE FIGURES

FIGS. 8*a-c* illustrate conventional antenna mounted on a substrate;

FIG. 9*a* illustrates an antenna with a field-altering element according to an embodiment of the present invention;

FIG. 9*b* is a side view of the antenna of FIG. 9*a* with field lines;

FIG. 9*c* is a top view of the antenna of FIG. 9*a* with field lines;

FIG. 10 illustrates an antenna with a field-altering element according to another embodiment of the present invention;

DETAILED DESCRIPTION OF AN EXEMPLARY EMBODIMENT

The present application relates to decoupling the antenna of a communication device from unwanted near field interactions with other internal or external items. In one embodiment, the present invention relates to a mobile phone including a near field deflector which creates a null, and thus a false edge, preventing near field coupling. FIGS. 3-5 illustrate a primary resonator coupled with a secondary resonator which is a near field deflector in accordance with the principles of the present invention.

Figure 1:
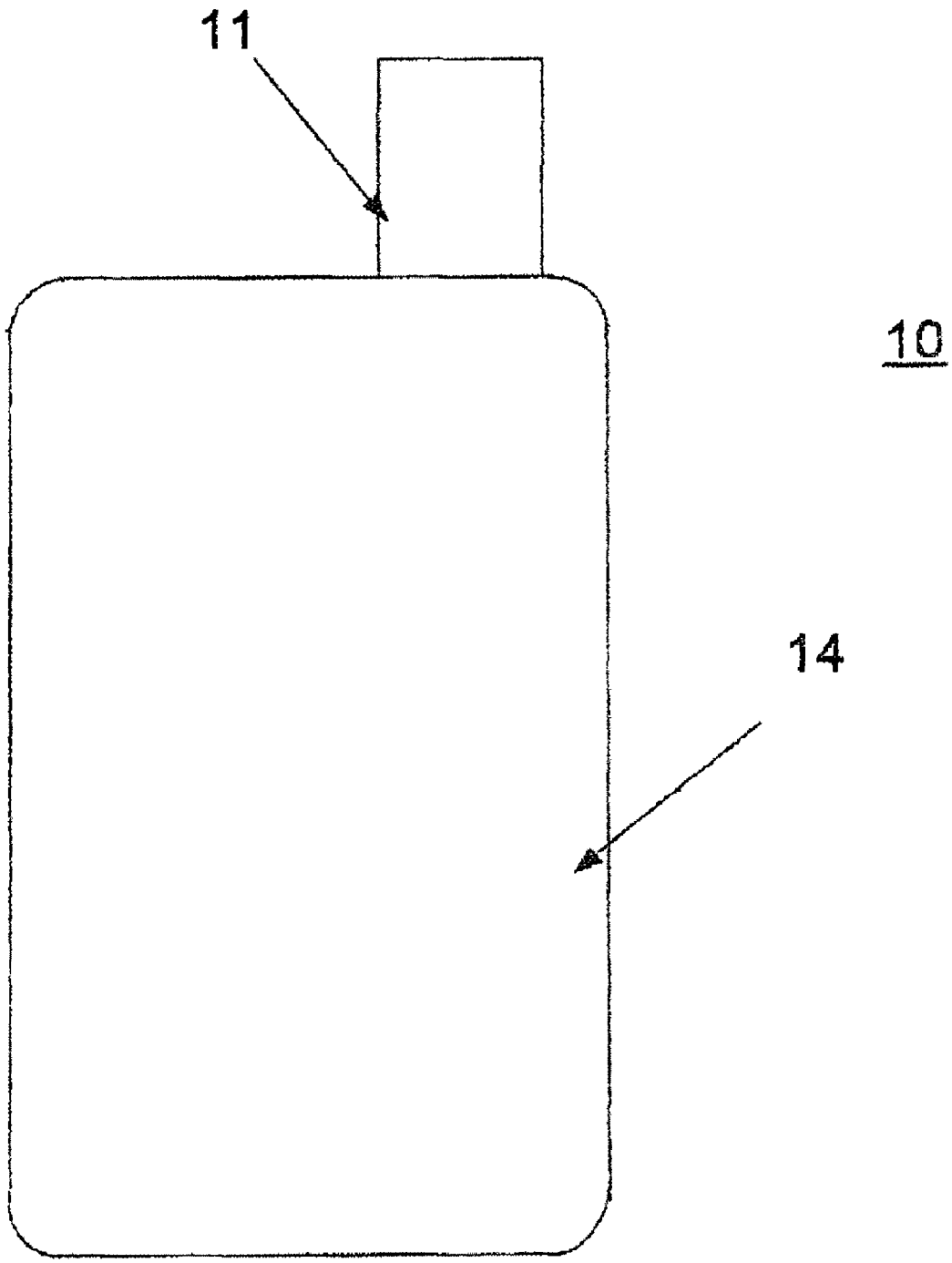
PRIOR ART Fig. 1
FIG. 1 illustrates a single, low frequency band prior art phone.

FIG. 1 illustrates a low frequency single band prior art phone (10). In FIG. 1, prior art phone (10) is shown to include one low frequency stub type antenna (11) extending from a phone housing (14). Those skilled in the art will understand the principles used to effectuate operation of phone (10) and stub antenna (11) at only one low frequency, for example, at 450 MHz. Those skilled in the art will also recognize that when used with a portable communications device, for example, a cell phone, operation of the stub antenna (11) at a single low frequency would require that the antenna comprise dimensions that are relatively large compared to the size of the phone housing (14).

Figure 2:
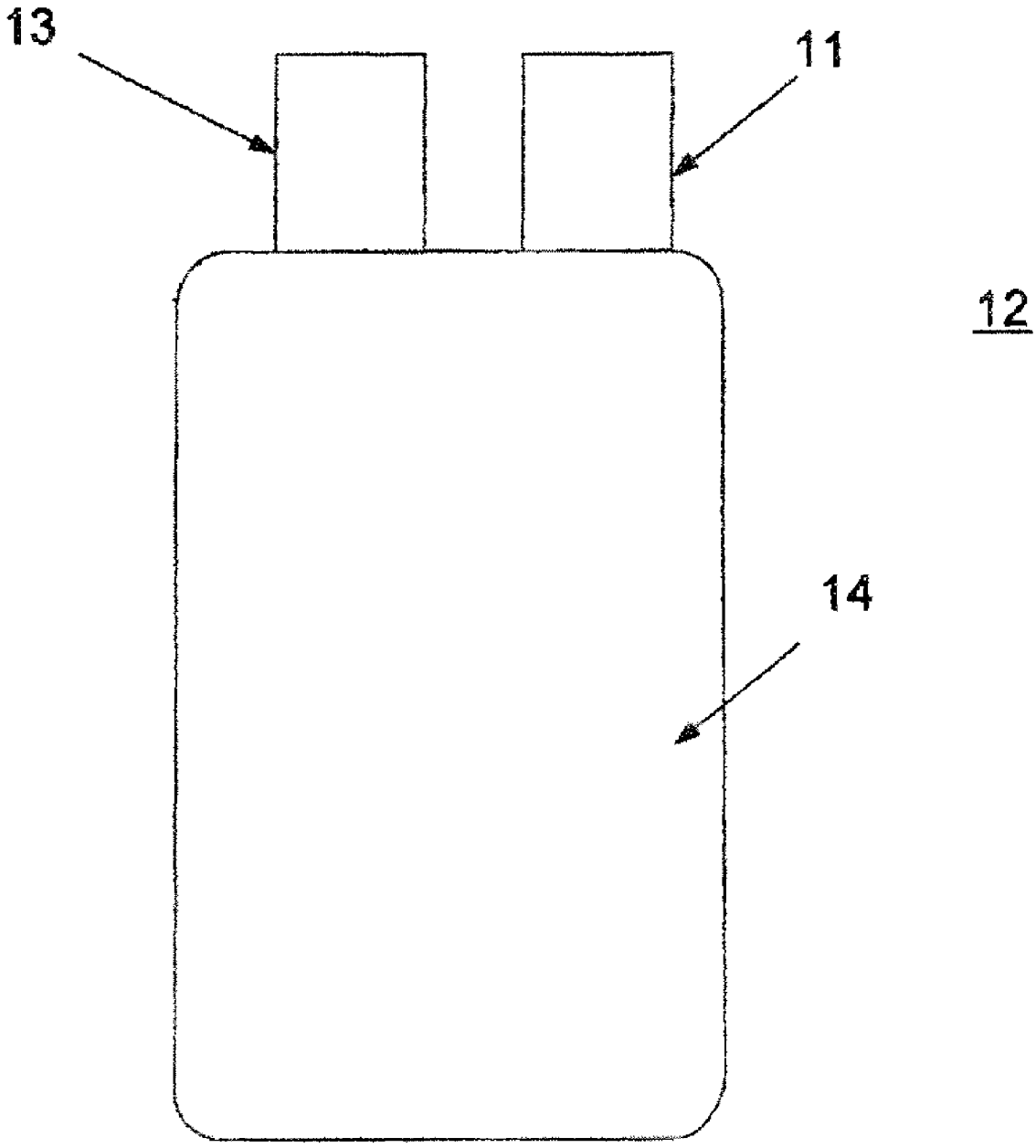
PRIOR ART Fig. 2
FIG. 2 illustrates a multi-band, low frequency prior art phone.

FIG. 2 illustrates a multi-band, low frequency prior art phone (12). In FIG. 2, prior art phone (12) is shown to include two or more low frequency stub type antennas (11) and (13) extending from a phone housing (14). Those skilled in the art will understand the principles used to effectuate operation of phone (12) and stub antennas (11) and (13) at two low frequencies, for example, at 430 and 450 MHz. Those skilled in the art will also recognize that design of cell phone (12) for use with two or more low frequency stub antennas would require that the phone housing (14) be able to accommodate the relatively large size of the antennas. With the cell phone designer's desire for an ever decreasing phone size, design of cell phones for use with two or more relatively large antennas poses an increasingly difficult challenge.

Figure 3A:
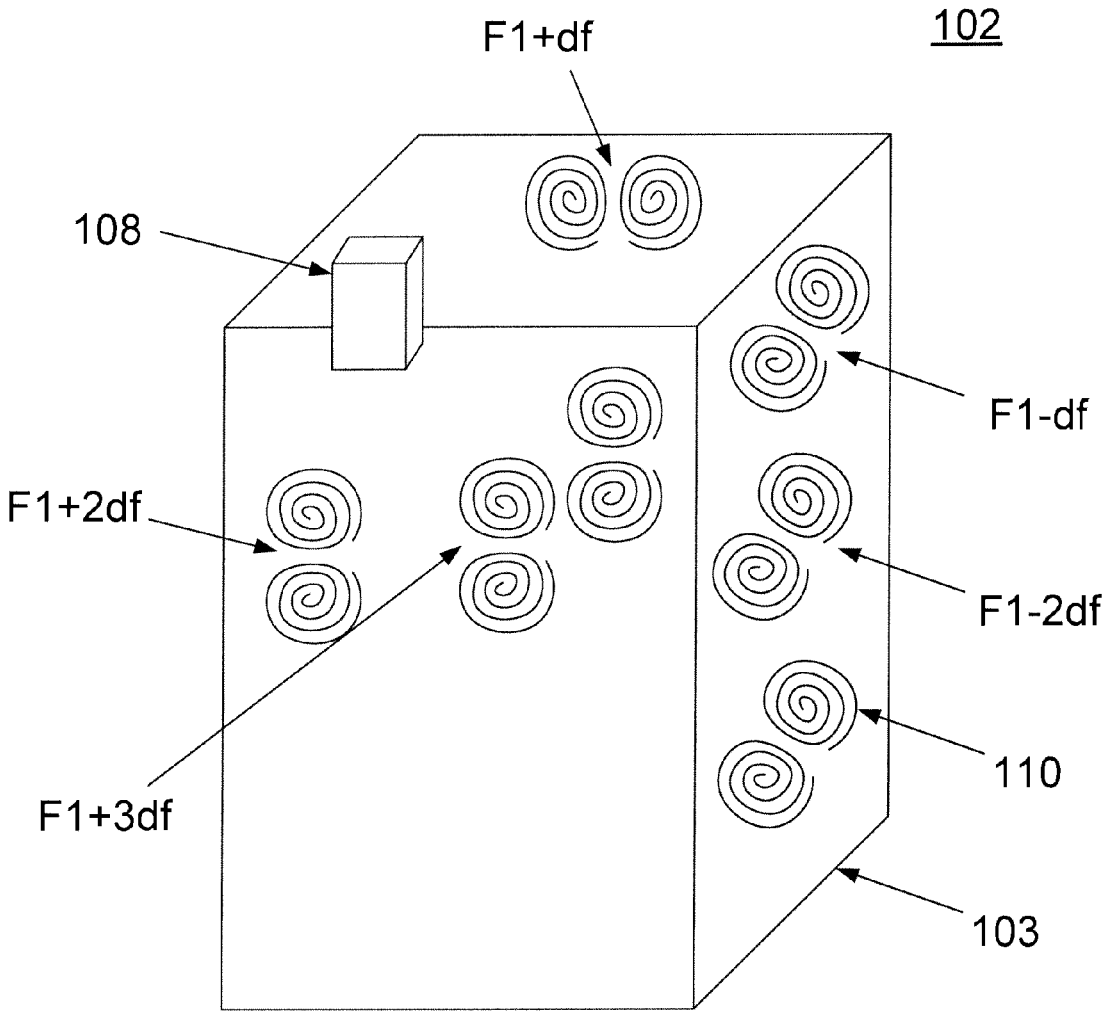
FIG. 3*a* illustrates a phone designed to be operated at a primary low frequency F1 and one or more other low frequency.

FIGS. 3*a-g* illustrate characteristics of a multi-band, low frequency phone (102) designed in accordance with one or more of the principles described below. In FIG. 3*a* there is shown one embodiment of a phone (102) designed to be operated at a primary low frequency F1 and one or more other low frequencies. In one embodiment, phone (102) comprises a cell phone, PDA, or other communications device. Phone (102) includes a housing (103), a primary resonator element (108) designed to resonate at a primary frequency F1, and one or more parasitic resonator elements (110) designed to resonate at a frequency different from that of the primary resonator element (108).

Figure 3B:
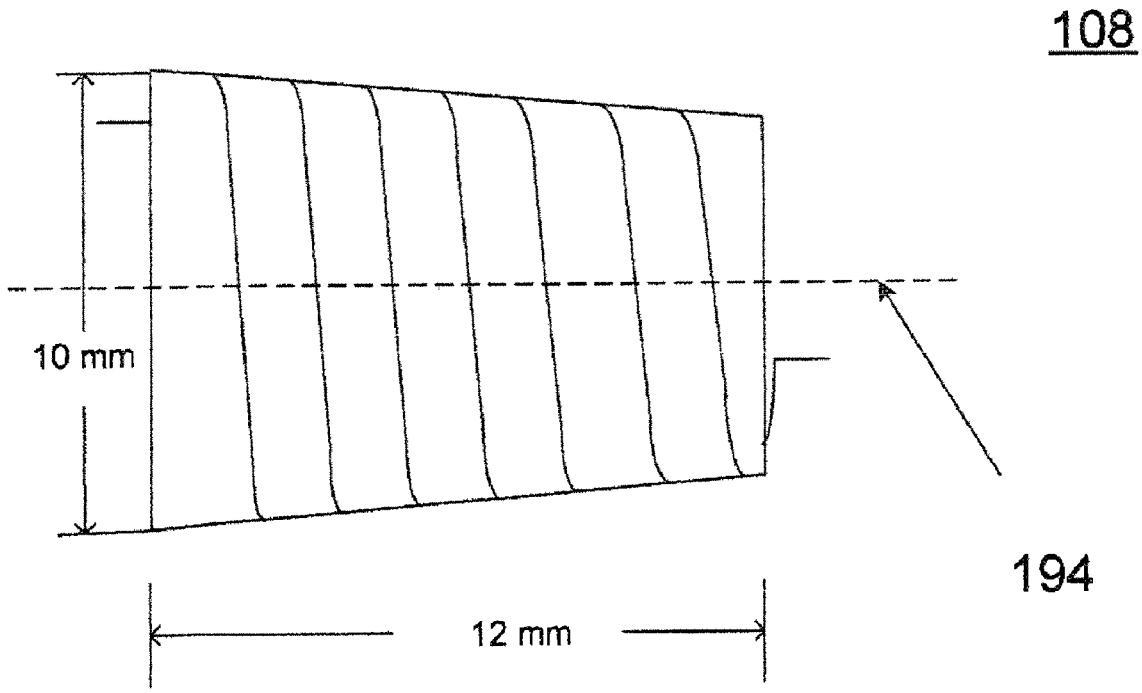
FIG. 3*b* illustrates one embodiment of a primary resonator.
Figure 3C:
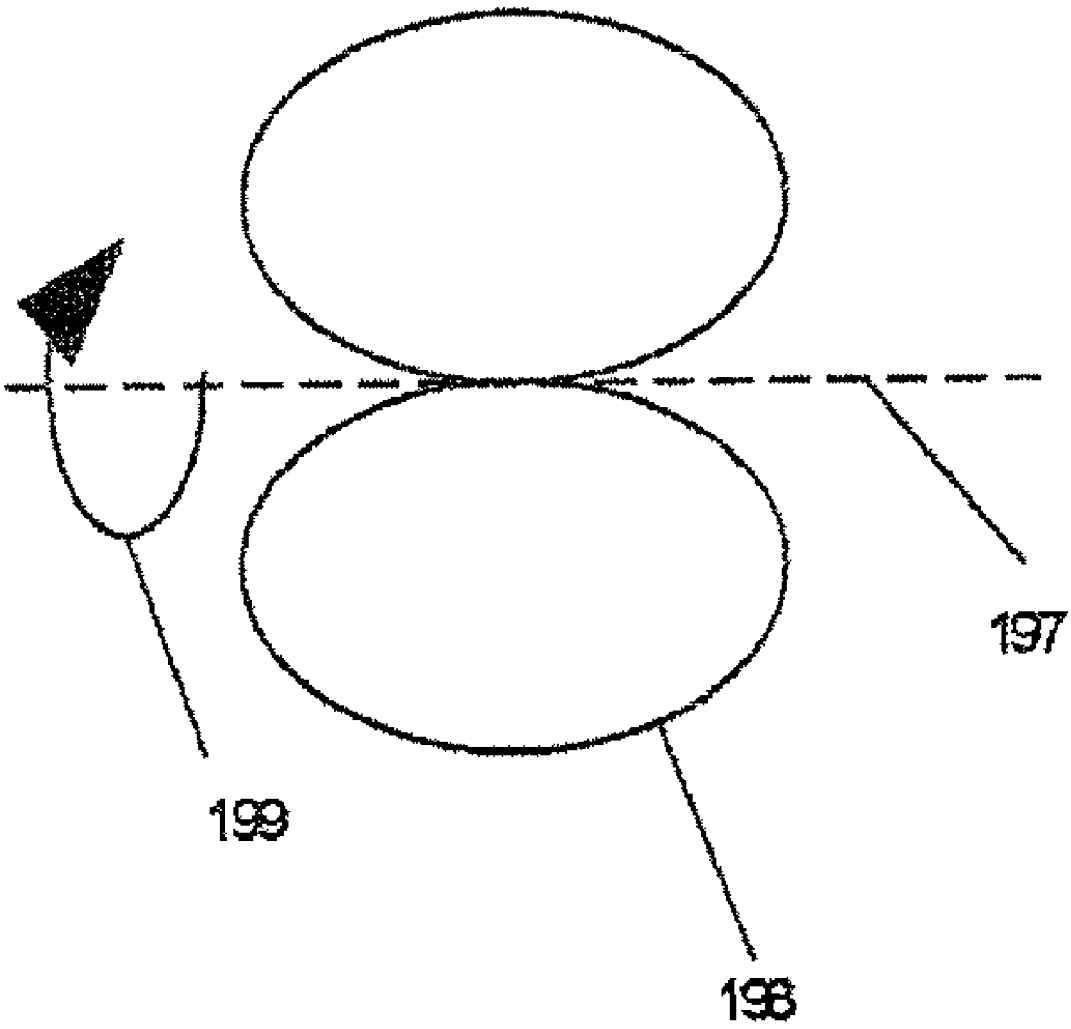
FIG. 3*c* illustrates a radiation pattern of a sample primary resonator.
Figure 4:
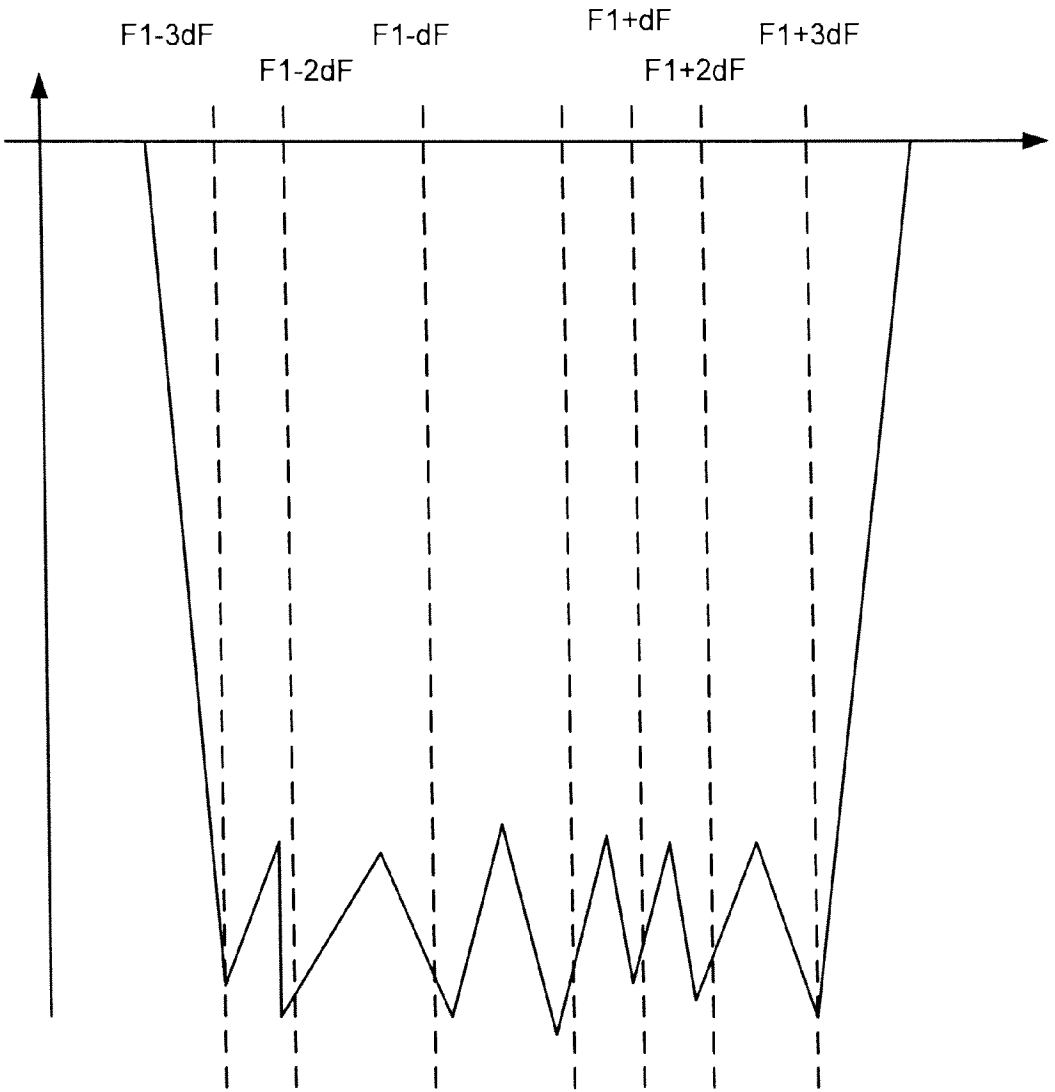
FIG. 4 illustrates the frequency response of a primary antenna as affected by the coupling effects of six parasitic resonator elements.

FIG. 3*b* illustrates one embodiment of a primary resonator element (108). In one embodiment, primary resonator element (108) comprises a stub-type antenna concentrically centered about an axis (194). In one embodiment, antenna (108) is designed to effectuate a dipole-type radiation pattern, for example, as is illustrated by FIG. 3*c*. In the illustrative embodiment of FIG. 3*c*, an axis (197) of the dipole radiation pattern corresponds to the centrally located axis (194) of antenna (108).

In the illustrative embodiment of FIG. 3*c*, although only a cross-section in one plane of the dipole radiation pattern (198) of antenna (108) is shown, in actual operation, the radiation pattern extends about the axis (197) in a direction (199), and similarly about the centrally-located axis of antenna (108). The geometries illustrated in FIG. 3*b* are illustrative of one embodiment and are not meant to be limiting of the present invention. Thus, it is understood that in other embodiments, by utilizing well known principles understood by those skilled in the art, primary antenna (108) may comprise other geometries that effectuate operation of phone (102) at other low frequencies and with other radiation patterns.

In one embodiment, the one or more parasitic resonator element (110) of FIG. 3*a* comprises a geometry designed such that when a resonance mode of the resonator element is excited, the radiation pattern of the one or more resonator element (110) couples to the radiation pattern of the primary antenna (108).

Figure 3D:
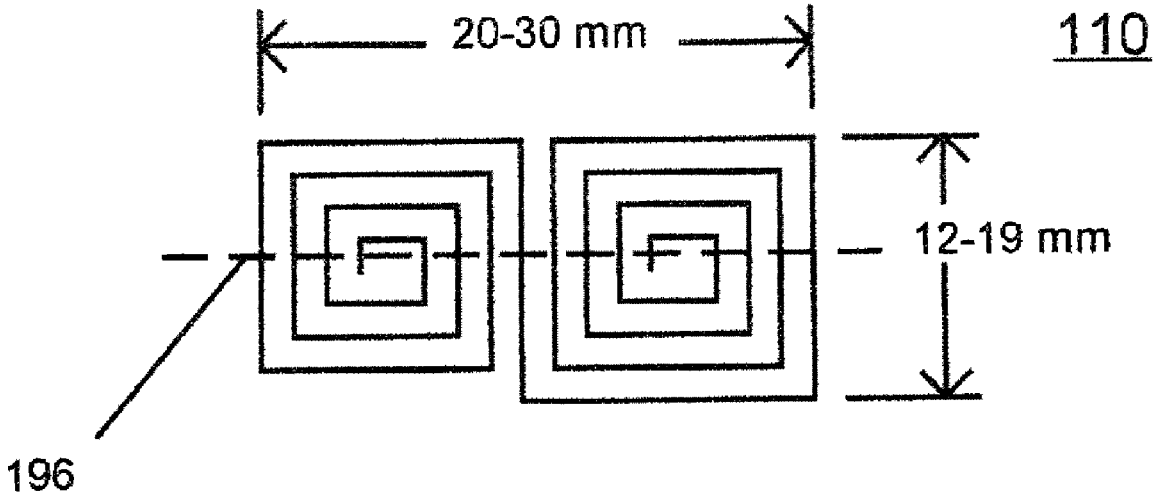
FIG. 3*d* illustrates one embodiment of a parasitic resonator element.

In one embodiment, one or more parasitic resonator element (110) may comprise a spiral shaped geometry, for example as illustrated in FIG. 3*d*. The geometries and dimensions illustrated in FIG. 3*d* are illustrative only and are not meant to be limiting of the present invention. It is understood that in other embodiments, by utilizing well known principles understood by those skilled in the art, parasitic resonator element (110) may comprise other geometries and dimensions to effectuate operation of phone (102) at other low frequencies and with other radiation patterns. In one embodiment, parasitic resonator element (110) comprises a conductor, for example, copper or the like. In one embodiment, resonator element (110) may be formed on a substrate, for example, by the deposition of conductive traces on the substrate. In one embodiment, one or more parasitic resonator element (110) is designed to effectuate a quadruple type radiation pattern as illustrated by FIG. 3*e*.

Figure 3E:
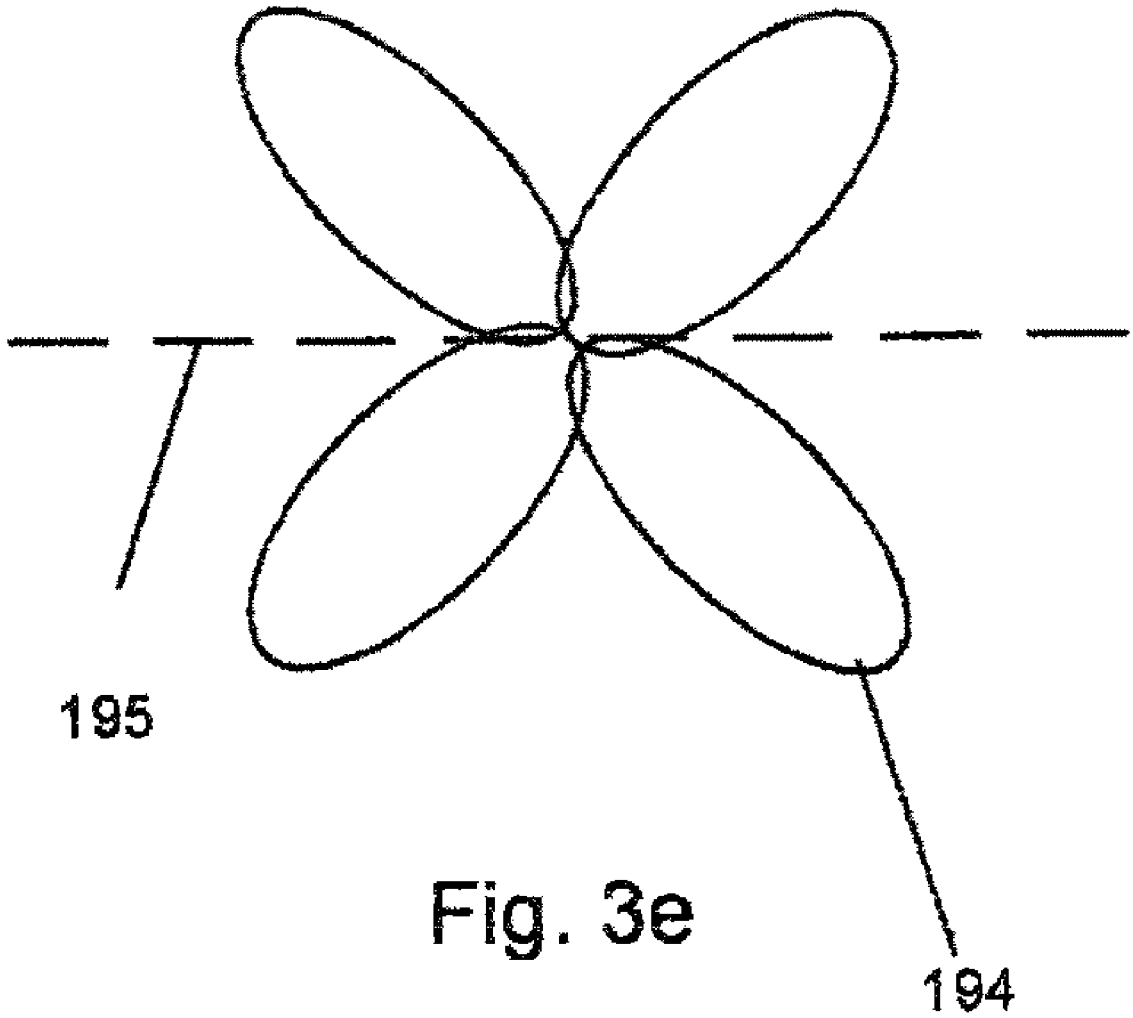
FIG. 3*e* illustrates a radiation pattern of sample a parasitic resonator element.

In the illustrative embodiment of FIG. 3*e*, a major axis (195) about which the radiation pattern of a resonator element (110) is centered, corresponds to a major axis (196) of the resonator element (110). One advantage that derives from using a resonator element (110) shaped in the form of a spiral is that its resonant frequency can be adjusted easily without large concomitant changes in geometry. For example, by reducing the gap between the spiral traces of a resonator element (110) and by increasing the number of turns in the spiral, the resonant frequency of the resonator element may be changed. It is also identified that the geometry of the radiation pattern of a spiral resonator element (110) is such that it may be positioned to overlap the radiation pattern of antenna (108) in a manner that permits beneficial reduction of the distance between the antenna (108) and resonator element (110), and such that a small phone may accommodate a primary antenna (108) and resonator element (110) combination. It is further identified that an antenna (108) and resonator element (108) combination described herein obviates the need for a bulky second antenna, for example, a second stub type antenna as is used in the prior art.

Figure 3F:
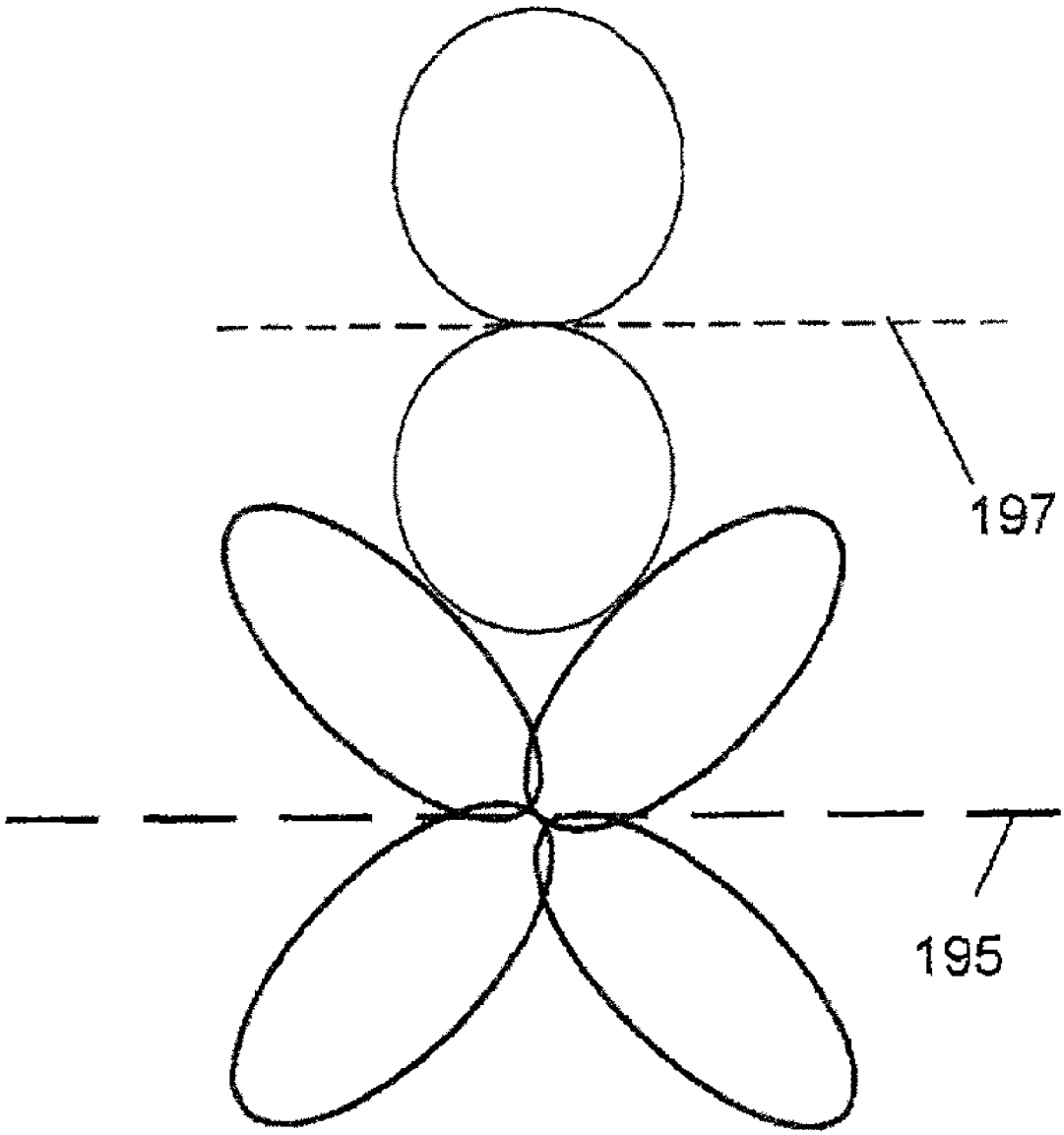
FIG. 3*f* illustrates the radiation patterns of a primary antenna and a parasitic resonator element positioned to achieve placement of a lobe of the radiation pattern of the resonator element between lobes of the radiation pattern of the primary antenna.

In FIG. 3*f* it is identified that appropriate positioning of a primary antenna (108) and resonator element (110) may be used to achieve a placement of a lobe of the radiation pattern of the resonator element (110) to overlap lobes of the radiation pattern of the primary antenna (108). It is identified that such positioning may be used to reduce the distance needed to parasitically couple resonator element (110) to primary antenna (108) in the near field. Such a method of coupling in the near field may be used to optimize overall return loss and efficiency of the antenna (108) without affecting the omnidirectional far field pattern, which can be smoothed by diffraction of the shape of a cell phone housing.

Figure 3G:
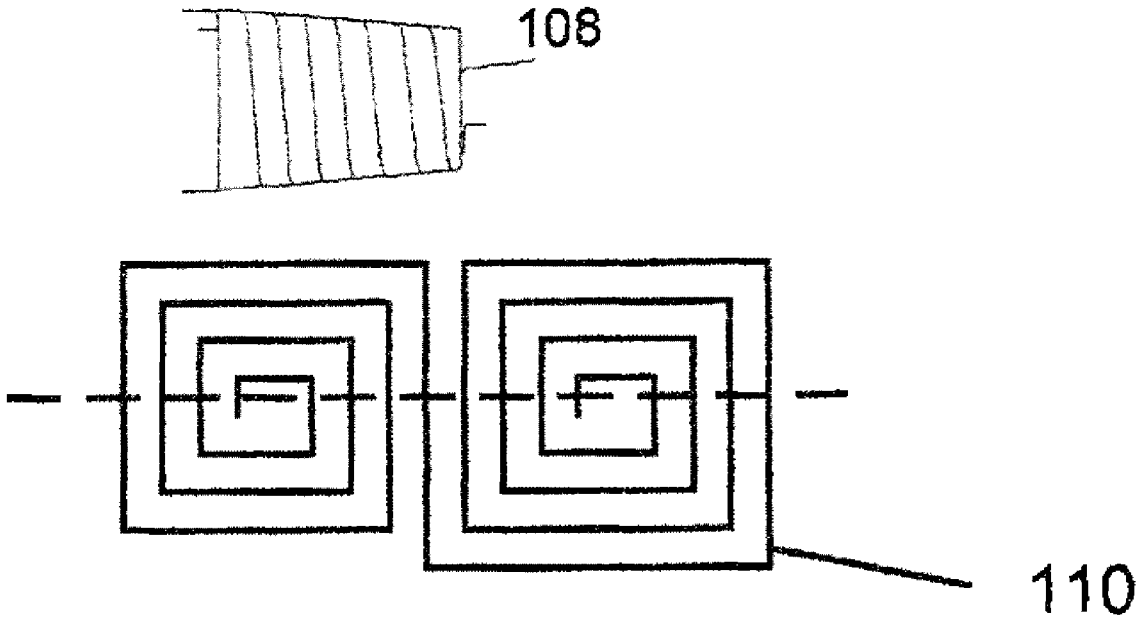
FIG. 3*g* illustrates one of many possible geometrical orientations between a primary antenna and a resonator element.

FIG. 3*g* illustrates one of many possible geometrical orientations of a primary antenna (108) and a resonator element (110) that may be used to effectuate operation of a phone at two low frequencies. In one embodiment, optimal coupling between primary antenna (108) and resonator element (110) may be achieved by disposing resonator element (110) approximately 6 mm from the antenna (108). In one embodiment, the central axis of a primary antenna (108) may be disposed generally parallel to the central axis of a resonator element (110). In one embodiment, the central axis of a primary antenna (108) may be disposed generally perpendicular to the central axis of a resonator element (110). Other angular orientations and other distances that achieve optimal coupling between a primary antenna (108) and one or more resonator element (110) are possible and within the scope of the invention and would be understood by those skilled in the art. Those skilled in the art will also understand that the positioning that achieves optimal coupling may be affected by placement of shields and other metallic components and may, thus, vary from one design to another design.

FIG. 4 illustrates the frequency response of a primary antenna (108), as affected by the coupling effects of six parasitic resonator elements. In one embodiment, the resonance mode of each of six resonator elements (110) comprises a frequency that differs from the primary frequency F1 of antenna (108) by a multiple of df, for example, by F1-3*df*, F1-2*df*, F1-*df*, F1+df, F1+2df, and F1+3df. It is identified that the effect of coupling one or more parasitic element may be used to increase the number of frequencies and/or the bandwidth over which the primary antenna (108) of a phone (102) may operate. As illustrated by FIG. 4, in one embodiment that utilizes six parasitic resonator elements (110), the frequency over which antenna (108) operates is envisioned to be increased by +/−3df. It is identified that such multiple band operation of a primary antenna (110) may be, thus, achieved without the need for more than one relatively large low frequency antenna.

Figure 5A:
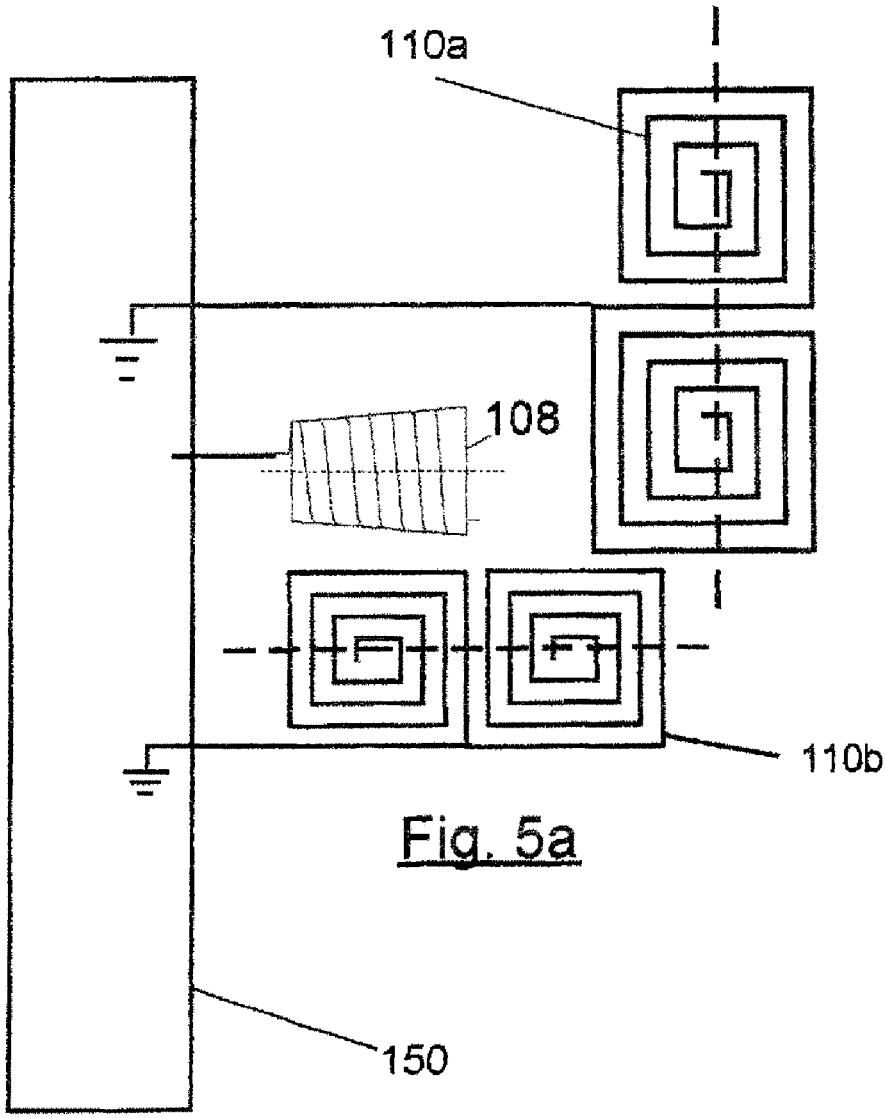
FIG. 5*a* illustrates an embodiment wherein two parasitic resonator elements and a primary antenna are connected to a substrate of a multi-band, low frequency prior art phone.

FIG. 5*a* illustrates a primary resonator (108) and two parasitic resonator elements (110*a-b*) electrically connected to one or more circuit of a phone (102). In one embodiment, spiral parasitic resonator elements (110*a-b*) are coupled to ground connections at a substrate (150), and the primary resonator (108) is coupled at one end to an antenna feed connection at the substrate (150). In one embodiment, primary resonator (108) comprises a 450 MHz helical coil antenna designed to conform to a 10 mm stub shaped housing with a pitch of 1.4 mm and with 5.5 turns, and resonator elements (110*a-b*) comprise geometries designed to create two different resonances at which a primary resonator (108) operates, for example at 380 and 410 MHz.

Figure 5B:
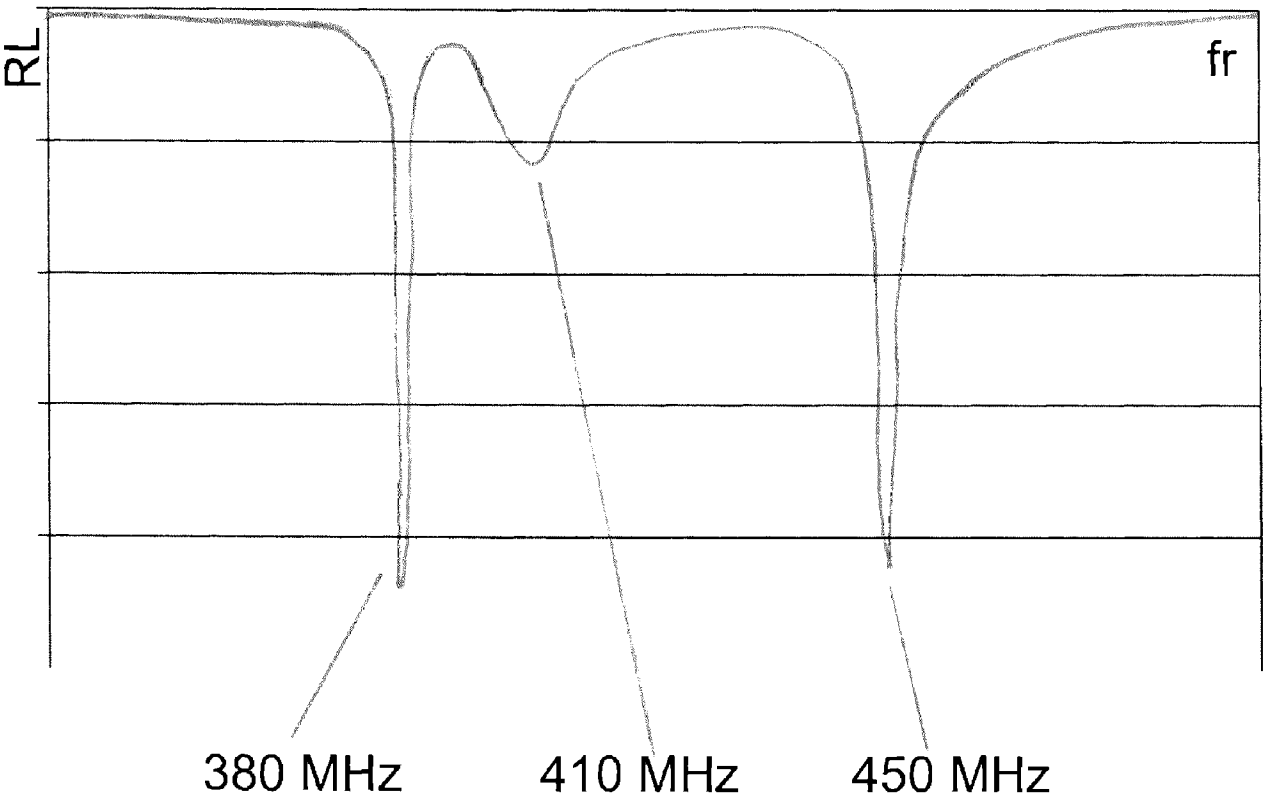
FIG. 5*b* illustrates a return loss graph of a primary antenna as affected by two parasitic resonator elements.

FIG. 5*b* illustrates a return loss graph of a primary resonator (108), wherein two of the three illustrated return loss minima (corresponding to primary resonator (108) operating frequencies 380 MHz, 410 MHz, 450 MHz) are effectuated by the parasitic coupling of resonator elements (110*a-b*) with the primary resonator (108).

The combination of a primary resonator (108) and one or more parasitic resonator element (110) may be integrated and mounted into phone housings in a number of ways. In one embodiment, because the primary antenna (108) may differ very little, if at all, from a conventional low-frequency antenna design, for example a helical coil antenna design, standard well known mounting techniques may be used to mount antenna (108), as for example, on, within, and/or outside a phone housing. It is identified that, when mounted within or a combination of within and outside a phone housing, a primary resonator (108) as described herein may be more closely positioned within the phone housing next to a parasitic element (110).

Because a parasitic resonator element (110), as described herein, requires relatively very little volume, one or more parasitic resonator element (110) may be used within a phone housing without adversely impacting the circuit design and ergonomics of the phone. In one embodiment, one or more parasitic resonator element (110) may be deposited or attached internal to a phone housing by simple mechanical attachment. In an embodiment where the resonator element is mounted on a substrate, the substrate may be attached to the phone housing. It is identified that a parasitic resonator element (110) may be designed to conform to the shape of a phone housing and, thus, may comprise a flat planar geometry, a curved geometry, or other geometry of the phone housing. With variations in geometry, it is understood that different parasitic resonator element (110) conductor spacing, turns, etc., may be required to achieve an equivalent coupling to a primary resonator (108), with such variations in geometry being achievable by those skilled in the art. In one embodiment, one or more parasitic resonator element (110) may be mounted into a thin film, and in mold decorating (IMD) techniques may be used to integrate the thin film into a phone housing. IMD techniques are known to those skilled in the art, and may be used to integrate spiral as well as other antenna geometries into a plastic phone housing. A variety of techniques known to those skilled in the art can be used to provide electrical connections to a parasitic resonator element (110), for example, a pogo pin connection, a flex cable connection, etc. Many other methods of mounting and coupling to parasitic resonator elements are also within the scope of the present invention and would be understood by those skilled in the art.

Figure 6:
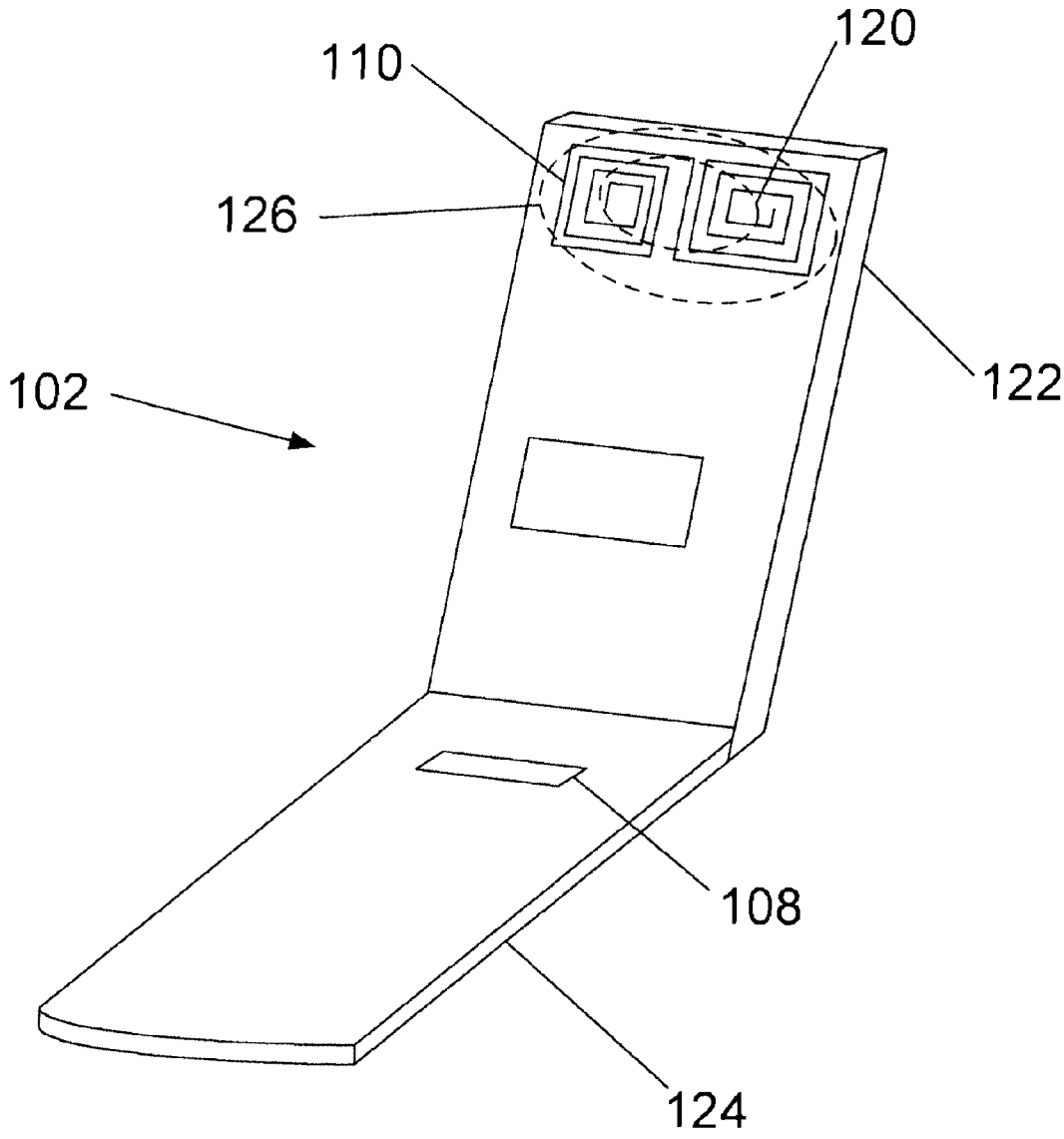
FIG. 6 illustrates a mobile communication device in accordance with the principles of the present invention having a secondary resonator positioned in association with a speaker of the device.

FIG. 6 illustrates a mobile phone in accordance with the principles of the present invention having a primary resonator 108 and a secondary resonator 110. The mobile phone includes a speaker 120 positioned in a first area 122 of the mobile phone 102 which would be associated with a user's ear when in use. The primary resonator 108 is positioned in a second area 124 of the mobile phone 102. In one exemplary embodiment, the mobile phone is a flip-style phone and the primary resonator 108 is positioned near the middle portion of the phone when in use. The secondary resonator 110 is positioned in the first area 122 so as to create a null 126 in the general area of the speaker 120. This null 126 results in a false edge in the near field, preventing near field coupling of the primary resonator 108 with the speaker 120 or other internal or external items such as earrings, etc.

In one embodiment, the near field deflector of the present invention may be positioned internal to the mobile phone, such as on a printed circuit board. In an alternative embodiment, the near field deflector is positioned outside of the housing of the mobile phone. In one exemplary embodiment, the near field deflector is adhesively connected to outer surface of the mobile phone so as to prevent near field coupling. In one embodiment, the near field deflector is printed on an adhesive-backed substrate such as paper.

The near field deflector of the present invention may be either grounded or ungrounded. In one embodiment, the near field deflector disposed in the mobile phone housing and grounded. In another embodiment, the near field deflector is positioned outside the mobile phone housing and is ungrounded.

The embodiments presented herein are not to be construed as limiting the scope of the invention. Although technologies and phone sizes may change with time, other frequencies that may considered to be "low" may come within the scope of the invention described herein. Thus, although communication devices operating at certain frequencies are discussed, the principles described herein are applicable to other frequencies. For example, frequencies at which phone (102) operates that are lower or higher than 1 GHz are envisioned and are within the scope of the present invention. Furthermore, although parasitic resonator elements (108) are described herein as comprising specific geometries, other geometries are also envisioned. For example, in one embodiment, parasitic element (108) may comprise a capacitively coupled dipole antenna geometry as is disclosed in commonly assigned patent application Ser. No. 10/375,423, filed on Feb. 27, 2003, which is incorporated herein by reference.

Figure 7:
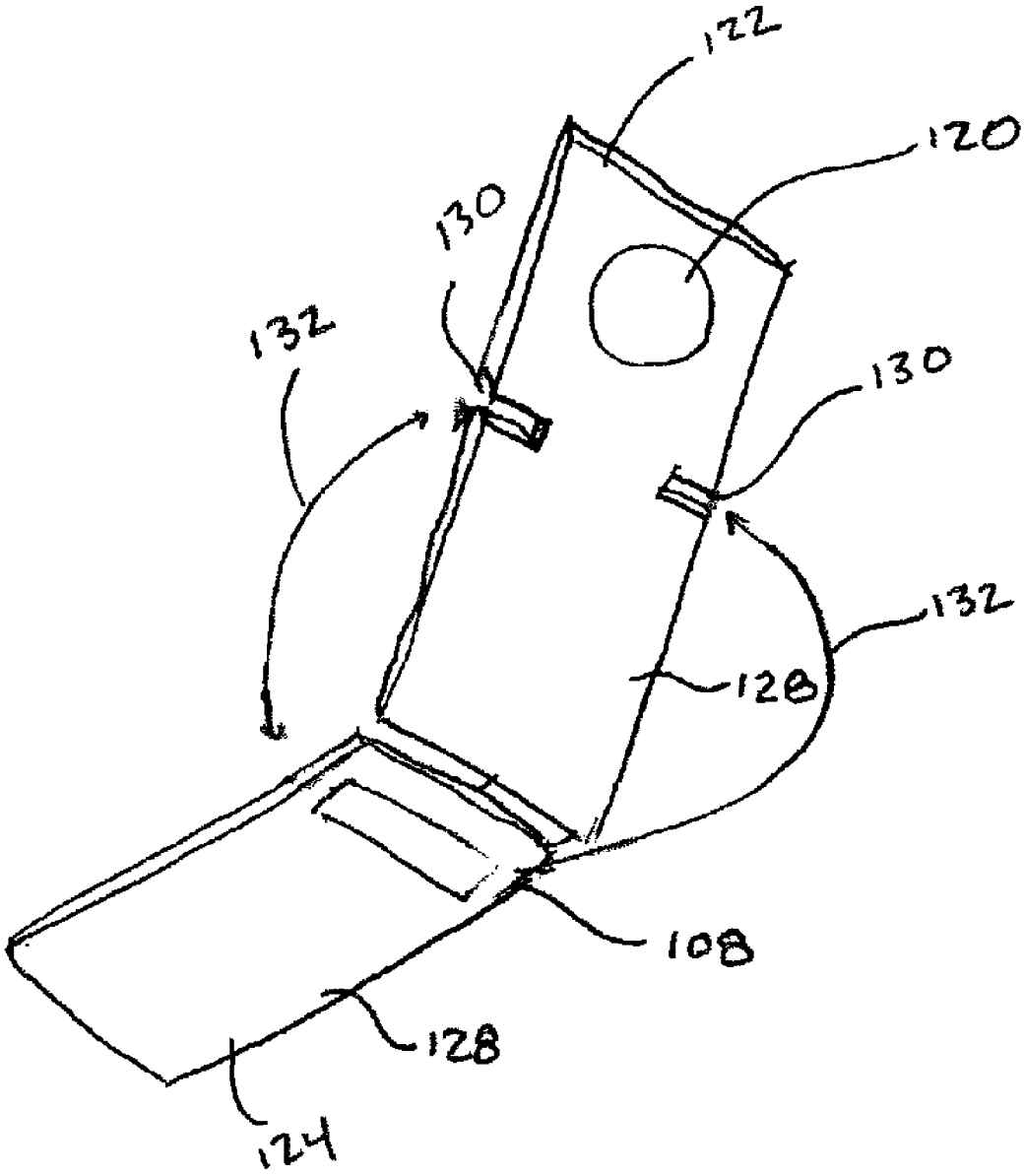
FIG. 7 illustrates a one embodiment of a printed circuit board with slots for use in a mobile communication device.

In another embodiment of the invention, illustrated in FIG. 7, the mobile phone 102 includes an internal printed circuit board 128 which carries the mobile phone electronics. In this embodiment, a "false edge" can be created by notching the printed circuit board 128 located in the first area 122 in an area between the speaker 120 and the primary resonator 108, which is positioned in the second area 124. In this embodiment, the slots 130 in the printed circuit board 128 appear to be an edge and thus, near field interactions are diverted to the slots 130 and away from the speaker 120 (and other items near the speaker such as the user's earring, etc.).

In another aspect of the invention, a field altering element may be used to alter the field lines of a primary resonator element to create a null, thereby avoiding coupling with other components.

FIGS. 8*a-c* illustrate a conventional antenna arrangement 20. In this arrangement, a primary antenna component 24 is mounted on a substrate 22. As seen in FIGS. 8*b* and 8*c*, the field lines span wrap around the primary antenna component 24 and the substrate 22. Such conventional antenna arrangements have a strong likelihood of coupling not only with internal components such as speakers, but also with external devices such as hearing aids. Embodiments of the invention described below with reference to FIGS. 9-14 facilitate reducing or eliminating the likelihood of such coupling.

FIGS. 9*a-c* illustrate one embodiment of an antenna arrangement according to the present invention. The antenna arrangement 200 illustrated in FIGS. 9*a-c* may be used in a variety of wireless devices such as, for example, wireless phones. The antenna arrangement 200 includes a substrate 202 with a primary antenna component 204 disposed on the substrate 202. Additionally, a field-altering element 206 is provided on the substrate 202 on the side of the substrate 202 on which the primary antenna component is disposed. In the embodiment illustrated in FIGS. 9*a-c*, the field-altering element 206 is a loop element positioned parallel to the primary antenna component and between the primary antenna component and the end of the substrate. The exact position of the field altering element 206 determines the overall behavior of the field generated by the antenna arrangement 200. Thus, as illustrated most clearly in FIG. 9*b*, the addition of the field altering element 206 generates an altered field (when compared to the field illustrated in FIGS. 8*a-c*). Further, an equivalence is created between two paths of the field. The first path is the equivalent electrical length of the upper part of the substrate 202 from the field-altering element 206, and the second path is the electrical length of the field-altering element 206. Thus, again as most clearly seen in FIG. 9*b*, a null region is created above the field-altering element 206 where a speaker may be accommodated. Further, an external device such as a hearing aid positioned in that region will be free from coupling with the antenna.

The field altering element 206 may be a conductor or any kind of loaded material adapted to conduct current. Further, the field altering element 206 may be plain or loaded with a component to modify the overall length. The field altering element 206 may be affixed to the substrate 202 by soldering or through a spring contact.

FIG. 10 illustrates an antenna arrangement according to an embodiment of the invention. The embodiment of FIG. 10 is a variation of the embodiment described above with reference to FIGS. 9*a-c*. In the embodiment of FIG. 10, an antenna arrangement 210 includes a substrate 212 with a primary antenna component 214 mounted thereon. A field-altering element 216 is positioned on the opposite side of the substrate 212 from the side on which the primary antenna component 214 is mounted.

Figure 11A:
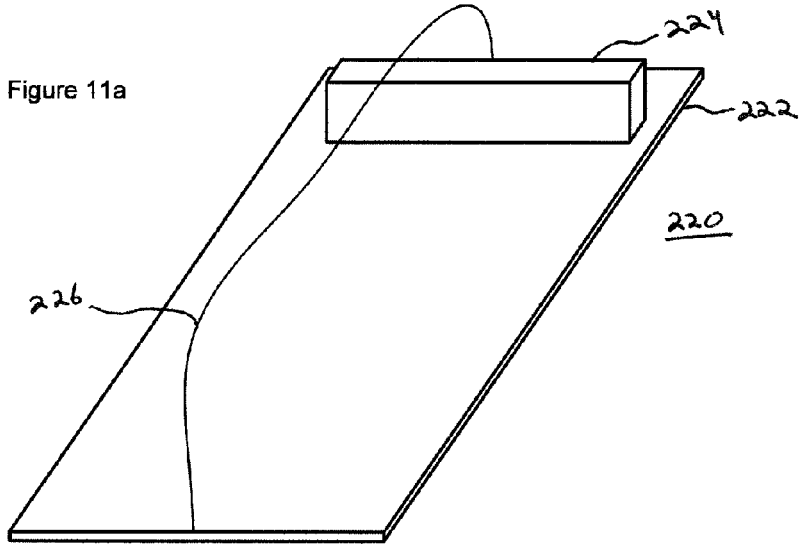
FIG. 11*a* illustrates an antenna with a field-altering element according to an embodiment of the present invention.
Figure 11B:
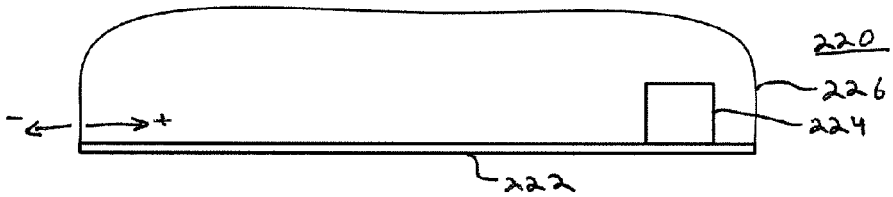
FIG. 11*b* is a side view of the antenna of FIG. 9*a* with field lines.
Figure 11C:
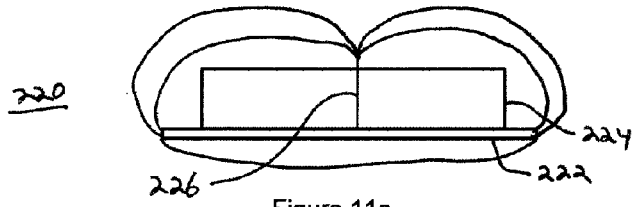
FIG. 11*c* is a top view of the antenna of FIG. 9*a* with field lines.

FIGS. 11*a-c* illustrate another embodiment of an antenna arrangement according to the present invention. Similar to the antenna arrangement 200 described above with reference to FIGS. 9*a-c*, the antenna arrangement 220 illustrated in FIGS. 11*a-c* includes a substrate 222 with a primary antenna component 224 mounted thereon and a field-altering element 226 provided on the substrate 222 on the side of the substrate 222 on which the primary antenna component 224 is mounted. In the embodiment illustrated in FIGS. 11*a-c*, the field-altering element 226 is positioned perpendicular to the primary antenna component substantially along the middle of the substrate 222. As illustrated most clearly in FIG. 11*c*, the field is altered (when compared to the field illustrated in FIG. 8*c*), and a null region is created above the field-altering element 226 where a speaker may be accommodated. Further, an external device such as a hearing aid positioned in that region will be free from coupling with the antenna.

Figure 12:
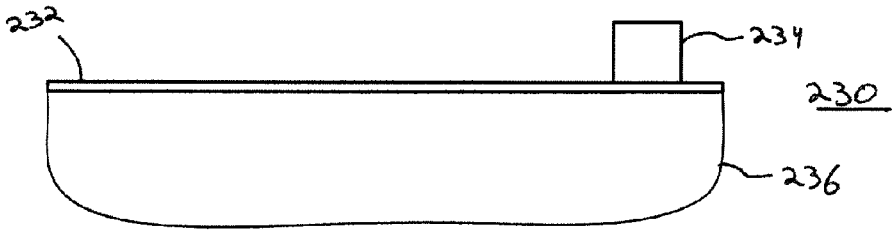
FIG. 12 illustrates an antenna with a field-altering element according to another embodiment of the present invention.

FIG. 12 illustrates an antenna arrangement according to another embodiment of the invention. The embodiment of FIG. 12 is a variation of the embodiment described above with reference to FIGS. 11*a-c*. In the embodiment of FIG. 12, an antenna arrangement 230 includes a substrate 232 with a primary antenna component 234 mounted thereon. A field-altering element 236 is positioned on the opposite side of the substrate 232 from the side on which the primary antenna component 234 is mounted.

Figure 13A:
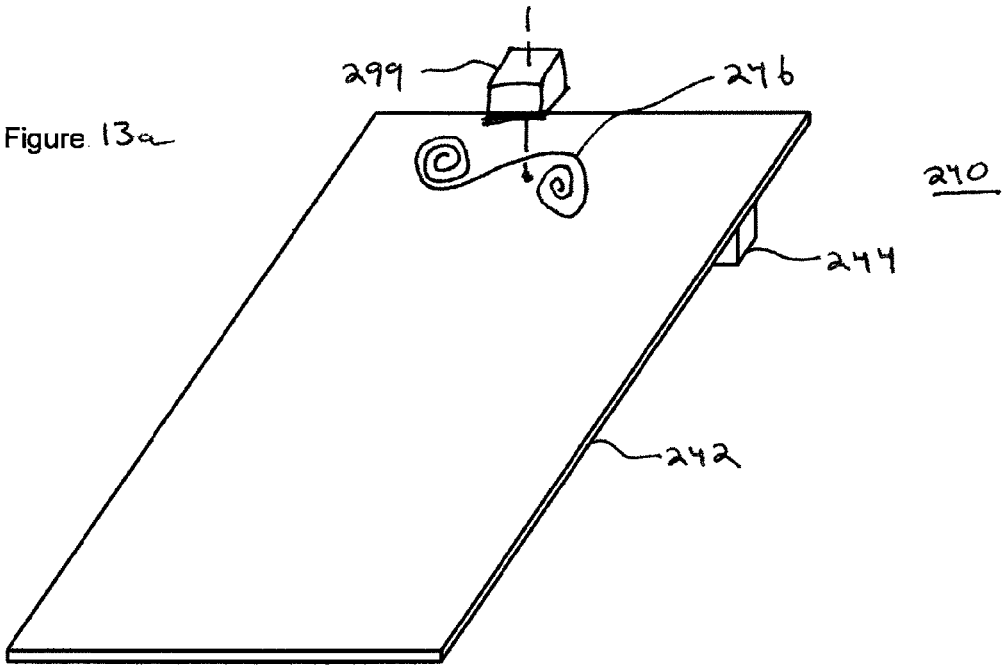
FIG. 13*a* illustrates an antenna with a field altering element according to an embodiment of the present invention, operating near a hearing aid.
Figure 13B:
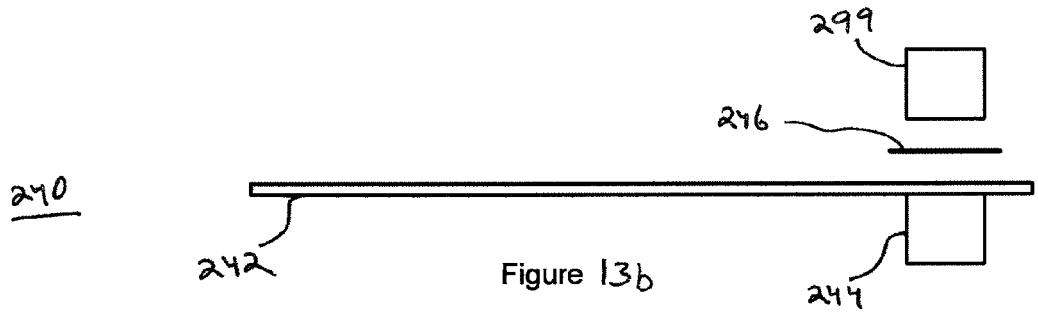
FIG. 13*b* is a side view of the arrangement of FIG. 13*a;*
Figure 13C:
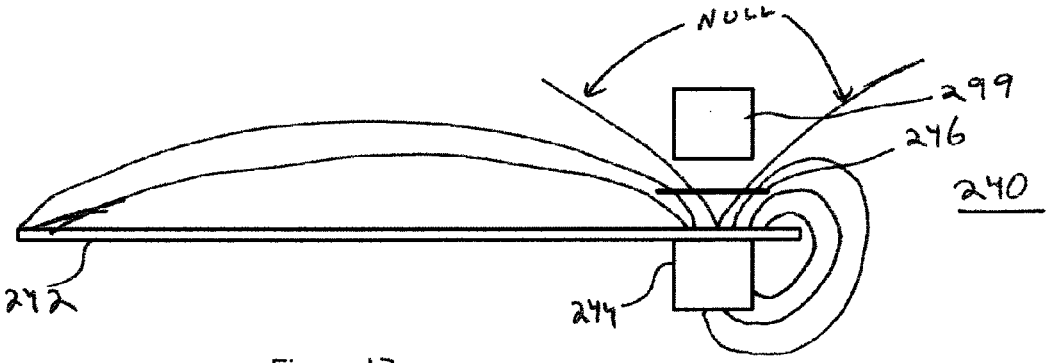
FIG. 13*c* is a side view of the arrangement of FIG. 13*a* with field lines.

FIGS. 13*a-c* illustrate an antenna arrangement according to an embodiment of the present invention and its relation to an external device such as a hearing aid. FIGS. 13*a-c* illustrate an antenna arrangement 240 having a substrate 242 with a primary antenna component 244 mounted on one side thereof. On the opposite side of the substrate 242, a planar field altering element 246 is positioned at a distance from the substrate 242. The planar field altering element 246 is positioned substantially parallel to the substrate 242. In a wireless phone, for example, the planar field altering element 246 may be mounted on the enclosure of the wireless phone.

As illustrated in FIG. 13*a*, in one embodiment, the planar field altering element 246 has a dual-loop spiral configuration. The specific configuration of the planar field altering element 246 is not limiting of the invention, and those skilled in the art will recognize and appreciate that many other configurations are possible and are contemplated within the scope of the present invention.

A hearing aid 299, as may be worn by a user of a wireless phone containing the antenna arrangement 240, is illustrated as being proximate to the antenna arrangement 240. As illustrated most clearly in FIG. 13*c*, positioning of the planar field altering element 246 above the portion of the substrate 242 opposite the position of the primary antenna component 244 creates a null in the region in which the hearing aid 299 would be positioned. Thus, coupling between the antenna arrangement 240 and the hearing aid 299 is avoided.

Figure 14B:
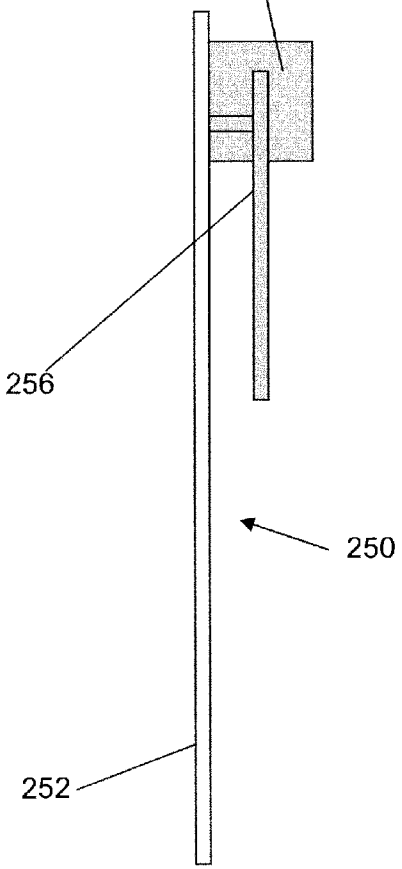
FIG. 14*b* is a side view of the arrangement of FIG. 14*a*.
Figure 14A:
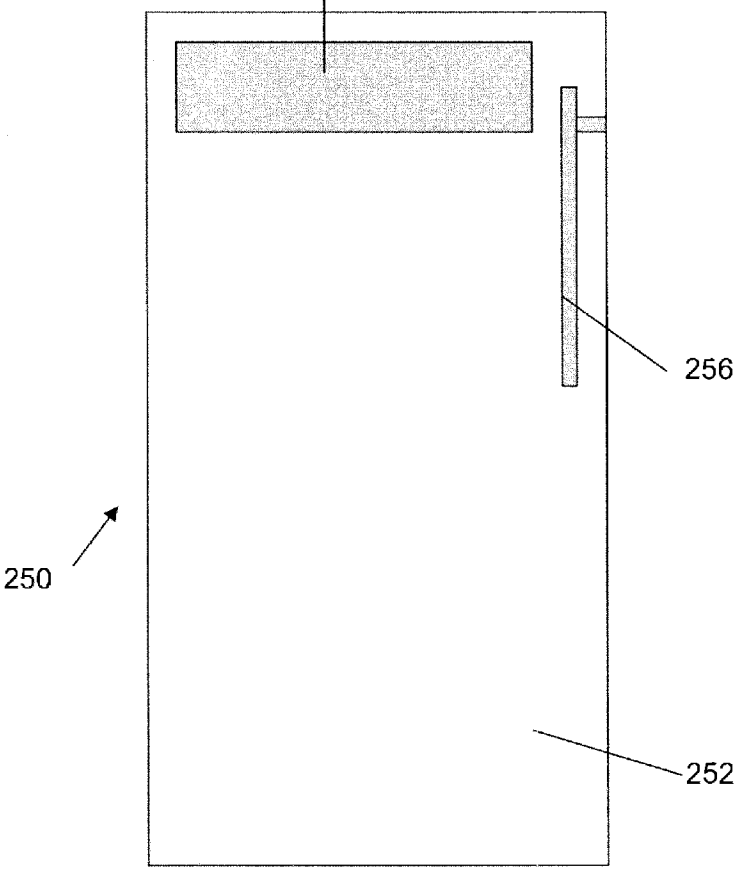
FIG. 14*a* a illustrates an antenna with a current unbalancing element according to an embodiment of the present invention.

FIGS. 14*a* and *b* illustrate one embodiment of an antenna arrangement according to the present invention. The antenna arrangement 250 illustrated in FIGS. 14*a* and *b* may be used in a variety of wireless devices such as, for example, wireless phones. The antenna arrangement 250 includes a substrate 252 with a primary antenna component 254 disposed on the substrate 252. Additionally, a current unbalancing element 256 is provided on the substrate 252 on the side of the substrate 252 on which the primary antenna component is disposed. In the embodiment illustrated in FIGS. 14*a* and *b*, the current unbalancing element 256 is a parasitic antenna element positioned on the edge of the substrate 252.

The current unbalancing element 256 can be tuned to a certain frequency which, together with its exact position with respect to the primary antenna component 254, will determine the overall behavior of the field generated by the antenna arrangement 250. The current unbalancing element 256 parasitically couples to the primary antenna component 254 thus unbalancing the current of the primary antenna component 254. This causes the antenna arrangement 250 to produce an altered field (when compared to the field generated by the primary antenna component 254 without the current unbalancing element 256). This altered fiend can cause a null region to be created for accommodating a speaker. Further, an external device such as a hearing aid positioned in that region will be free from coupling with the antenna.

The current unbalancing element 256 may be a conductor or any kind of loaded material adapted to conduct current. Further, the current unbalancing element 256 may be plain or loaded with a component to modify the overall length. The current unbalancing element 256 may be affixed to the substrate 252 by soldering or through a spring contact.

Thus, it will be recognized that the preceding description embodies one or more invention that may be practiced in other specific forms without department from the spirit and essential characteristics of the disclosure, and that the invention is not to be limited by the foregoing illustrative details, but rather is to be defined by the appended claims.

We claim:

1. A multi-frequency communications device having a speaker, comprising;

a primary resonator, the primary resonator for enabling at least one frequency at which the device operates;

a near field deflector which generates a null associated with the position of the speaker; and a printed circuit board on which the speaker and primary resonator are disposed, wherein the near field deflector comprises at least one slot in the printed circuit board, the at least one slot being positioned between the primary resonator and speaker; and wherein the near field deflector forms a false edge substantially preventing coupling of the primary resonator to the speaker.

2. A mobile communications device, comprising:

a housing a printed circuit board disposed inside the housing;

a speaker disposed on the printed circuit board;

a primary resonator disposed on the printed circuit board;

slots in the printed circuit board in an area between the speaker and primary resonator;

wherein the slots create a false edge for preventing coupling of the primary resonator with the speaker.

* * * * *